US006387867B1

(12) United States Patent
Ishikawa et al.

(10) Patent No.: US 6,387,867 B1
(45) Date of Patent: May 14, 2002

(54) LIQUID DETERGENT COMPOSITION CONTAINING MIXTURES OF GLYCEROL ETHER COMPOUNDS

(75) Inventors: Akira Ishikawa; Takumi Inoeu; Kazutoshi Ide; Kazunori Tsukuda, all of Wakayama (JP)

(73) Assignee: Kao Corporation, Tokyo (JP)

( * ) Notice: Subject to any disclaimer, the term of this patent is extended or adjusted under 35 U.S.C. 154(b) by 0 days.

(21) Appl. No.: 09/762,471

(22) PCT Filed: Jul. 31, 2000

(86) PCT No.: PCT/JP00/05134

§ 371 Date: Apr. 6, 2001

§ 102(e) Date: Apr. 6, 2001

(87) PCT Pub. No.: WO01/10990

PCT Pub. Date: Feb. 15, 2001

(30) Foreign Application Priority Data

Aug. 9, 1999 (JP) ..... 11-225092

(51) Int. Cl.[7] ..... C11D 1/72; C11D 1/825

(52) U.S. Cl. ..... 510/421; 510/271; 510/289; 510/356; 510/405; 510/413; 510/506

(58) Field of Search ..... 510/271, 289, 510/356, 405, 413, 421, 506

(56) References Cited

U.S. PATENT DOCUMENTS 4,199,464 A * 4/1980 Cambre ..... 252/91
4,206,070 A * 6/1980 Jones ..... 252/174.21
4,430,237 A * 2/1984 Pierce et al. ..... 252/173
6,232,283 B1 * 5/2001 Inoue et al. ..... 510/405

FOREIGN PATENT DOCUMENTS

| | | | |
|---|---|---|---|
| EP | A1980869 | | 2/2000 |
| JP | A7500861 | | 1/1995 |
| JP | A1036306 | | 2/1998 |
| WO | A1-9309214 | | 5/1993 |
| WO | A1-9514073 | | 5/1996 |
| WO | 00/43340 | * | 7/2000 |
| WO | A1-0043340 | | 7/2000 |

* cited by examiner

*Primary Examiner*—Charles Boyer
(74) *Attorney, Agent, or Firm*—Birch, Stewart, Kolasch & Birch, LLP

(57) ABSTRACT

The present invention provides a liquid detergent being excellent in detergency for persistent sebum smears such as smears in or on collars and cuffs and for denatured-oil smears in kitchens, etc., and further having a good smell as a detergent. That is, the present invention provides a liquid detergent comprising glycerol ether compounds represented by each of the formulas (1), (2), and (3) and a surfactant, R—O—$CH_2$—CH(OH)$CH_2$X (1), R—O—CH($CH_2$X)$CH_2$Y (2), and R—O—$CH_2$—CH(Z)$CH_2$W (3), wherein R, X, Y, W and Z are defined in the specification.

5 Claims, No Drawings

LIQUID DETERGENT COMPOSITION CONTAINING MIXTURES OF GLYCEROL ETHER COMPOUNDS

This application is the national phase under 35 U.S.C. §371 of PCT International Application No. PCT/JP00/05134 which has an International filing date of Jul. 31, 2000, which designated the United States of America.

TECHNICAL FIELD

The present invention relates to a liquid detergent.

BACKGROUND ART

The liquid detergent used in an ordinary home may include a detergent for a hard surface, which is directed to a metal, a glass, a ceramic, a plastic and the like, and a detergent for a clothing, which can be applied directly to smears in or on a clothing. These detergents are blended with solvents such as, for example, methyl cellosolve and methyl carbitol in order to improve their detergent effect. However, the liquid detergent blended with these solvents are still not satisfactory in respect of detergency for persistent sebum smears such as smears in or on collars and cuffs and denatured-oil smears etc. in kitchens as well as smells derived from the solvents.

Meanwhile, JP-A 7-500861 describes a detergent composition comprising a mixture of an alkyl monoglyceryl ether and an alkyl diglyceryl ether as nonionic surfactants and a anionic surfactant. Further, U.S. Pat. No. 4,430,237 describes a detergent composition comprising a mixture of an alkyl glyceryl ether, an alkyl diglyceryl ether and an alkyl triglyceryl ether as nonionic surfactants. However, these compositions are still not satisfactory in respect of detergency for sebum smears etc. because of higher contents of the diglyceryl and triglyceryl ethers relative to the monoglyceryl ether.

In addition, a detergent for human body having improvement of its foaming property and rinsing property is demanded in particular for hair shampoo, body shampoo, face washing, hand washing and so on.

DISCLOSURE OF INVENTION

The object of the present invention is to provide a liquid detergent being excellent in detergency for persistent sebum smears such as smears in or on collars and cuffs and for denatured-oil smears etc. in kitchens and further having good smell as detergent.

The present invention relates to a liquid-detergent comprising (a) a compound represented by the following formula (1), (b) a compound represented by the following formula (2), (c) a compound represented by the following formula (3) and (d) a surfactant, wherein (a)+(b)+(c)=0.1 to 50% by weight, (a)/[(a)+(b)+(c)]=0.5 to 0.99, (b)/[(a)+(b)+(c)]=0.005 to 0.25 and (c)/[(a)+(b)+(c)]=0.005 to 0.25 (of which each and all are the ratios by weight):

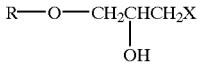

(1)

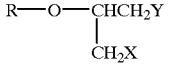

(2)

-continued

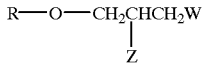

(3)

wherein R is a hydrocarbon group containing from 1 up to 16 carbon atoms, X is selected from the group consisting of a hydroxyl group and an OR group, Y is also selected from the group consisting of a hydroxyl group and an OR group, and Z is selected from the group consisting of a hydroxyl group,

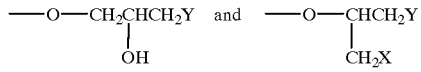

and W is also selected from the group consisting of a hydroxyl group,

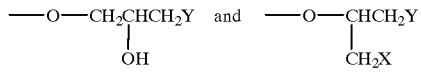

provided that either Z or W is a hydroxyl group.

The above defined composition comprises three different glyceryl ether compounds from one another, (1), (2) and (3). It is preferable that both of Z and W are not hydroxyl group.

A composition containing the above-shown liquid detergent is useful as a detergent for domestic use such as washing of cloth, woven or non-woven fabrics, textile goods, tableware, dishes, glass, cup, metal goods, ceramic goods, plastic goods, kitchen, bathroom, bathtub, furniture and human body.

MODE FOR CARRYING OUT THE INVENTION (a) to (c) Glyceryl Ether Type Compounds

The compounds represented by the following formulae (1), (2) and (3) can be used as the components (a), (b) and (c) in the present invention:

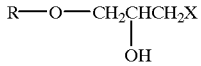

(1)

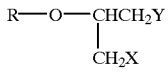

(2)

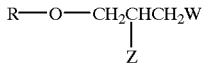

(3)

wherein R represents a hydrocarbon group having 1 to 16 carbon atoms, X is selected from the group consisting of a hydroxyl group and an OR group, Y is also selected from the group consisting of a hydroxyl group and an OR group, Z is selected from the group consisting of a hydroxyl group,

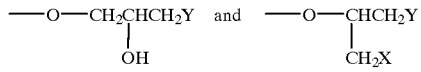

and W is also selected from the group consisting of a hydroxyl group,

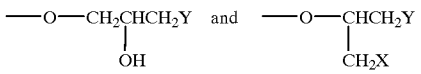

provided that either Z or W is a hydroxyl group. Here, it is preferable that both of Z and W are not hydroxyl group. Further, at least one of Z and W is preferably a hydroxyl group.

In the formulae, R is preferably a hydrocarbon group having 3 to 12 carbon atoms, particularly 4 to 10 carbon atoms, in respect of improving the detergency. In particular, when the liquid detergent is used in washing by application, R is preferably an alkyl group having 7 to 9 carbon atoms, particularly 8 carbon atoms, in respect of detergent performance towards sebum smears in or on collars, cuffs etc. Further, when it is used as a detergent for hard surfaces, R is preferably an alkyl group having 4 to 6 carbon atoms. X, Y and Z are preferably hydroxyl groups. In addition, W is preferably

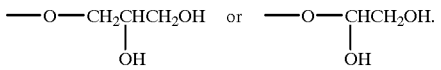

Specifically, the following compounds (4) to (9) can be mentioned as each of the above-described compounds:

(4)

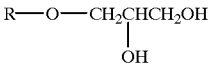

(5)

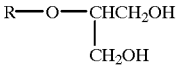

(6)

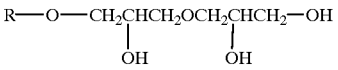

(7)

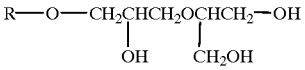

(8)

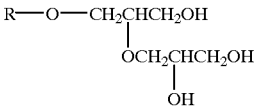

(9)

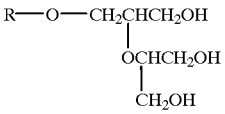

wherein R represents an alkyl group having 1 to 16 carbon atoms, preferably an alkyl group having 4 to 6 or 8 carbon atoms.

Among them, the compounds (4), (5), (6) and (7) are preferable, and the compounds (4) and (5) are preferable in respect of detergent performance in washing by application in particular.

In respect of detergency and smell, the total amount ((a)+(b)+(c)) of the components (a), (b) and (c) in the present invention is 0.1 to 50% by weight, preferably 0.5 to 20% by weight, more preferably 1 to 15% by weight, as compared with the liquid detergent.

The ratio by weight of the component (a) to the said total amount ((a)/[(a)+(b)+(c)]) is 0.5 to 0.99, preferably 0.8 to 0.99, more preferably 0.86 to 0.99 and particularly preferably 0.9 to 0.99. Then, the ratio by weight of the component (b) to the said total amount ((b)/[(a)+(b)+(c)]) is 0.005 to 0.25, preferably 0.005 to 0.1, more preferably 0.005 to 0.07 and particularly preferably 0.005 to 0.05. Further, the ratio of the component (c) to the said total amount ((c)/[(a)+(b)+(c)]) is 0.005 to 0.25, preferably 0.005 to 0.1, more preferably 0.005 to 0.07 and particularly preferably 0.005 to 0.05.

The ratio by weight of the component (b) to the component (a) is preferably 0.001 to 0.1, more preferably 0.005 to 0.05, and the ratio by weight of the component (c) to the component (a) is preferably 0.001 to 0.15, more preferably 0.005 to 0.1. Further, in respect of improving the detergency, the ratio of the total amount of the components (b) and (c) to the component (a) (that is, [(b)+(c)]/(a)) is preferably 0.001 to 0.3, more preferably 0.005 to 0.2 and particularly preferably 0.01 to 0.15.

By the way, it is general that the compounds represented by the formulae (1) to (3) are produced by a process of reacting an epoxy compound such as, for example, epihalohydrin and glycidol using an acid catalyst such as $BF_3$. However, the reaction of an alcohol with the epoxy compound occurs at random at 1- and 2-positions of the epoxy compound so that multiple addition-products are also formed. Accordingly, the resultant product is a mixture of the compound having an alcohol added at 1-position and being represented by the formula (1), the compound having an alcohol added at 2-position and being represented by the formula (2) and the multimer (which may be a multimeric compound, an oligomer or a polymer) having a large number of glyceryl groups added and being represented by the formula (3), and therefore the composition comprising the compounds (a) to (c) in a specific ratio for blend in the present invention was hardly obtained technically and economically.

Under these circumstances, the applicant found a method of using, for instance, an aluminum catalyst represented by the formula (10) described in WO 98/50389 as a method of economically and efficiently producing the above-described compounds in the present invention:

$$Al(OSO_2—R^1)_l(OR^2)_m(OR^3)_n \quad (10)$$

wherein $R^1$ represents a hydrocarbon group which may have a substitutent-group, $R^2$ is selected from the group consisting of a hydrocarbon group and a substituent hydrocarbon group, $R^3$ is selected from the group consisting of a hydrocarbon group and a substituted hydrocarbon group, l is 1 to 3, and each of m and n is an integer of 0 to 2, provided that l+m+n=3.

Here, $R^1$ is preferably an alkyl group having 1 to 5 carbon atoms (preferably a methyl group) or an aryl group which may have a hydroxyl group or an alkyl group having 1 to 5 carbon atoms (preferably a 4-tolyl (4-methylbenzoyl) group or a 4-hydroxyphenyl group). $R^2$ or $R^3$ is preferably an alkyl group having 1 to 10 carbon atoms (e.g. an isopropyl group or an octyl group) and a phenyl group.

The catalyst mentioned above can be produced by reacting e.g. sulfonic acid or the like with trialkyl aluminum, trialkoxy aluminum, trihalogenated aluminum or the like to substitute a part or all of alkyl groups, alkoxyl groups and halogen groups of the said aluminum compounds by the said sulfonate and then substituting the remaining alkyl groups, alkoxyl groups or halogen groups by a suitable alcohol or phenol. Such a substitution reaction as this is carried out by mixing them under heating in a solvent such as hydrocarbon and alcohol.

When the above-described aluminum catalyst is used in the present invention, it is good that an epoxy compound such as epihalohydrin and glycidol is used in an amount of 0.5 to 1.5 equivalents by mole, preferably 1.0 to 1.2 equivalents by mole, as compared with an alcohol having 1 to 16 carbon atoms, and the aluminum catalyst represented by the formula (10) is used in an amount of 0.001 to 0.1 equivalent by mole, preferably 0.01 to 0.05 equivalent by mole, as compared with the said alcohol, and the reaction is carried out at a reaction temperature of 10 to 120° C., preferably 70 to 110° C., for 1 to 5 hours. By use of the above-described method, the compounds (a) to (c) can be easily prepared in the desired ratio for blend.

(d) Surfactant

One or more members of anionic surfactants, nonionic surfactants, cationic surfactants and amphoteric surfactants can be mentioned as the surfactant (d) in the present invention. In particular, the anionic surfactant and/or nonionic surfactant is preferable. The anionic surfactants include alkyl benzene sulfonates, alkyl or alkenyl ether sulfates, alkyl or alkenyl sulfates, olefin sulfonates, alkane sulfonates, fatty acid salts, alkyl or alkenyl ether carboxylates, α-sulfonic acid salts or esters thereof; the nonionic surfactants include polyoxyalkylene alkyl or alkenyl ethers, alkyl polyglucosides, glucose amides and the like; the cationic surfactants include quaternary ammonium salts and the like; and the amphoteric surfactants include amine oxides, sulfobetaine, carbobetaine and the like.

In particular, the following surfactants (i) to (iv) are preferable in respect of detergency.

(i) A linear alkyl benzene sulfonate which has an alkyl group having 10 to 14 carbon atoms.

(ii) A polyoxyethylene alkyl or alkenyl ether sulfate which has an alkyl or alkenyl group having 8 to 18 carbon atoms, which preferably has an alkyl or alkenyl group having 10 to 16 carbon atoms and being an adduct with 1 to 8 moles, preferably 1 to 6 moles, of EO on the average.

(iii) A polyoxyalkylene type nonionic surfactant represented by the formula (11):

$$R^4X\text{—}[(PO)m(EO)n\text{—}H]p \quad (11)$$

wherein $R^4$ represents a hydrocarbon group having 8 to 20 preferably 10 to 18, carbon atoms; X represents an oxygen atom or a nitrogen atom; PO represents propylene oxide; EO represents ethylene oxide. Here, although the order for adding EO and PO is not minded, the form of addition is a random addition product or block addition product (, a block addition product is preferable in particular). Then, each of m and n is independently an integer of 0 to 20, and moreover n+m=3 to 25, preferably 5 to 20. Further, when X is an oxygen atom, p=1 and when X is a nitrogen atom, p=2.

(iv) An alkyl polyglucoside which has an alkyl group having 8 to 16 carbon atoms, which preferably has an alkyl group having 8 to 14 carbon atoms, wherein the average degree of polymerization of glucose is 1 to 3, preferably 1 to 2.

If the polyoxyalkylene type nonionic surfactant (iii) described above is blended, it is preferable to use a matter satisfying at least one of the following requirements (I) to (III).

(I) Among the compounds represented by the above-mentioned formula (11), the polyoxyalkylene alkyl ether type nonionic surfactant wherein $R^4$ is an alkyl group derived from a secondary alcohol and X is an oxygen atom.

(II) Among the compounds represented by the above-mentioned formula (11), the polyoxyethylene polyoxypropylene alkyl ether type nonionic surfactant wherein m and n means the average number of added moles, m is 4 to 16 and n is 1 to 5, and X is an oxygen atom.

(III) Among the compounds represented by the above-mentioned formula (11), the polyoxyethylene alkyl ether type nonionic surfactant wherein m is 0 and n is 5 to 15 in terms of the average number of moles, which has the compound of n=0 in a blended amount of 5% by weight or less, wherein when the number of added moles of the compound in the amount of maximum % by weight is made to n(max), the total of compounds having their numbers of added moles from [n(max)−2] to [n (max)+2] is 55% by weight or more, and wherein X is an oxygen atom.

When the compound (I) is blended as component (d), the liquid detergent is excellent in dispersibility and stability at storage. In particular, the liquid detergent comprising the compounds (I) to (III) as component (d) exhibits excellent detergency towards sebum smears by using it for clothing.

In the present invention, the content of component (d) in the liquid detergent is 0.1 to 50% by weight, and the ratio by weight of the component (d) to the total amount of the components (a), (b) and (c) (that is, (d)/[(a)+(b)+(c)]) in the liquid detergent of the present invention is preferably 0.1 to 10, more preferably 1.2 to 10, most preferably 1.5 to 5, in respect of improving the detergent performance. When the liquid detergent is used for clothing, the content of component (d) is preferably 30 to 50% by weight, when it is used for directly spraying or applying onto hard surfaces, the content thereof is preferably 0.1 to 10% by weight, and when it is used for the liquid detergent for tableware or human body, the content thereof is 8 to 50% by weight.

Various components such as alkalizing agents, chelating agents, viscosity regulators and hydrotropic agents can be blended into the liquid detergent of the present invention as far as the performance or effect of the present invention is not deteriorated.

The alkali agents include hydroxides such as sodium hydroxide, potassium hydroxide and calcium hydroxide, carbonates such as sodium carbonate, potassium carbonate and sodium sesquicarbonate (sodium monohydrogendicarbonate), silicates such as sodium silicate and potassium silicate, alkanolamines such as monoethanolamine, diethanolamine, triethanolamine and 2-amino-2-methyl-1-propanol, as well as morpholine and ammonia. Sodium hydroxide, potassium hydroxide, monoethanolamine, 2-amino-2-methyl-1-propanol, morpholine or ammonia is particularly preferable in respect of improving the detergency. The content of the alkali agent in the liquid detergent is preferably 0 to 20% by weight, more preferably 0.1 to 20% by weight.

The chelating agents include (i) phosphorus (or phosphoric) acid type compounds such as phytic acid or salts thereof, (ii) phosphonic acids such as ethane-1,1-diphosphonic acid, ethane-1,1,2-triphosphonic acid, ethane-1-hydroxy-1,1-diphosphonic acid, ethanehydroxy-1,1,2-triphosphonic acid, ethane-1,2-dicarboxy-1,2-diphosphonic acid and methanehydroxyphosphonic acid or salts thereof, (iii) phosphonocarboxylic acids such as 2-phosphonobutane-1,2-dicarboxylic acid, 1-phosphonobutane-2,3,4-tricarboxylic acid and α-methylphosphonosuccinic acid or salts thereof, (iv) amino acids such as aspartic acid, glutamic acid and glycine or salts thereof, (v) aminopolyacetic acids such as nitrilotriacetic acid, iminodiacetic acid, ethylene diamine tetraacetic acid, diethylene triamine pentaacetic acid, glycol ether diamine tetraacetic acid, hydroxy ethyl iminodiacetic acid, triethylene tetraamine hexaacetic acid and djenkolic acid or salts thereof, (vi) organic acids such as diglycollic acid, oxydisuccinic acid, carboxy methyl oxysuccinic acid, citric acid, lactic acid, tartaric acid, oxalic acid, malic acid, gluconic acid, carboxy methyl succinic acid and carboxy methyl tartaric acid or salts thereof, (vii) aminopoly(methylene phosphonic acid) polyethylene polyamine poly(methylene phosphonic acid), or salts thereof, (viii) alkyl glycine-N,N-diacetic acid, aspartic acid-N,N-diacetic acid, serine-N,N-diacetic acid, N,N-dicarboxymethyl glutamic acid (or glutamic acid diacetic acid), ethylene diamine disuccinic acid or salts thereof, and (ix) condensed phosphates such as pyrophosphate. Among them, the above-described compound (ii), (v), (vi) or (viii), particularly (ii), (v) or (viii), is preferable. The content of the chelating agent in the liquid detergent is preferably 0 to 30% by weight, more preferably 0.01 to 15% by weight in respect of improving the detergency.

The hydrotropic agents include salts of organic acids such as p-toluenesulfonic acid, m-xylenesulfonic acid, citric acid, malic acid and succinic acid (salts of alkaline metal are preferable). The content of the hydrotropic agent in the liquid detergent is preferably 0.1 to 10% by weight, more preferably 0.5 to 8% by weight.

As other components, it is possible to use lower alcohols such as ethanol and isopropanol, polyhydric alcohols (or polyol) such as glycerol and sorbitol, chlorides such as sodium chloride, potassium chloride and calcium chloride, sulfates such as sodium sulfate, potassium sulfate and calcium sulfate, sulfites such as sodium sulfite and potassium sulfite, enzymes such as cellulase, amylase, pectinase, protease and lipase, as well as perfumes, pigments (or dyes), preservatives, fungicides (or anti-fungus agents), thickeners and the like. In particular, when the product of the present invention is used as detergent for human body, the product may contain a moisturizer, a conditioning agent, a vitamin compound, a plant- or vegetable-extract, anti-inflammatory agent, anti-dandruff agent, an absorbent of ultraviolet ray or the like.

For use of the liquid detergent of the present invention, e.g. the above-described components (a) to (d) and optional components are diluted preferably with water. In particular, water, from which hardness components, heavy metals etc. have been removed, such as deionized water, is desirable. The content of the water in the liquid detergent is preferably 40 to 99% by weight, more preferably 50 to 95% by weight.

The liquid detergent of the present invention is excellent in detergency for persistent sebum smears such as smears in or on collars and cuffs and for denatured-oil smears etc. in kitchens and also excellent in handling without smells derived from the solvent components. In particular, the liquid detergent exhibits excellent detergent performance, when it is used in washing by application.

EXAMPLES

First, a mixture of components (a), (b) and (c) was prepared. Each of the components was quantitatively determined by absolute calibration of gas chromatography.

Preparative Example 1

Preparation of Mixture A 158 g (1.78 mol) of isoamyl alcohol, 3.61 g (17.7 mmol) of aluminum triisopropoxide and 9.40 g (5.4 mol) of p-phenolsulfonic acid were introduced into a reaction chamber (, reactor or bath for reaction) having its capacity of 1 L (liter) and heated to 90° C. under stirring. Further, the mixture was stirred for 1 hour under reduced pressure (200 mmHg) and then heated to 100° C. 170 g of epichlorohydrin were added dropwise thereto for 30 minutes and further stirred for 3 hours. This reaction mixture was kept at 50° C., and 800 ml of aqueous solution having 48% of sodium hydroxide were added dropwise thereto for 1 hour. The mixture was further stirred for 3 hours and then the reaction mixture was partitioned to plural layers by adding 400 ml of water. After the aqueous layer was removed, the oil layer was washed twice with 500 ml of water to obtain 280 g of a crude product after reaction.

Then, 140 g of the crude product after reaction, 140 g of water, 7.64 g of lauric acid and 2.14 g of potassium hydroxide were introduced into an autoclave having its capacity of 2 L and heated to 157° C. under stirring. After the resultant mixture was stirred for 5 hours, it was cooled to the room temperature and the resultant product after reaction was extracted with 500 ml of ethyl acetate and further washed twice with 300 ml of water. After the ethyl acetate was distilled off under reduced pressure, the resultant residues were applied to column chromatography. The obtained mixture was analyzed with a gas chromatography. As the result, it was a mixture containing 95% of the component (a), 3% of the component (b) and 2% of the component (c).

Preparative Example 2

Preparation of Mixture B

The mixture was prepared in the same manner as in Preparative Example 1 except that 1.78 mol of n-octanol were used in place of the isoamyl alcohol. The obtained mixture was analyzed with a gas chromatography. As the result, it was a mixture containing 88% of the component (a), 2% of the component (b) and 10% of the component (c).

Preparative Example 3

Preparation of Mixture C

The mixture was prepared in the same manner as in Preparative Example 1 except that 1.78 mol of n-dodecyl alcohol were used in place of the isoamyl alcohol. The obtained mixture was analyzed with a gas chromatography. As the result, it was a mixture containing 85% of the component (a), 3% of the component (b) and 12% of the component (c).

Preparative Example 4

Preparation of Mixture D 158 g (1.78 mol) of isoamyl alcohol and 4.9 g (34.9 mmol) of a complex comprising $BF_3$ with ethyl ether (Tokyo Kasei Kogyo K.K.) were introduced into a reaction chamber having its capacity of 1 L. Then, 170 g of epichlorohydrin were added dropwise thereto for 30 minutes under stirring, and the resultant mixture was further stirred for 3 hours. While this reaction mixture was kept at 50° C., 800 ml of aqueous solution having 48% of sodium hydroxide were added dropwise thereto for 1 hour. The mixture was further stirred for 3 hours and then the reaction mixture was partitioned to plural layers by adding 400 ml of water. After the aqueous layer was removed, the oil layer was washed twice with 500 ml of water to obtain 272 g of s crude product after reaction.

Then, 140 g of the crude product after reaction, 140 g of water, 7.64 g of lauric acid and 2.14 g of potassium hydroxide were introduced into an autoclave having its capacity of 2 L and heated to 157° C. under stirring. After the resultant mixture was stirred for 5 hours, it was cooled to the room temperature and the resultant product after reaction was extracted with 500 ml of ethyl acetate and further washed twice with 300 ml of water. After the ethyl acetate was distilled off under reduced pressure, the resultant residues were applied to column chromatography. The obtained mixture was analyzed with a gas chromatography. As the result, it was a mixture containing 61% of the component (a), 5% of the component (b) and 34% of the component (c).

Preparative Example 5

Preparation of Mixture E 158 g (1.78 mol) of isoamyl alcohol and 3.4 g (34.9 mmol) of sulfuric acid were introduced into a reaction chamber having its capacity of 1 L, and then 170 g of epichlorohydrin were added dropwise thereto for 30 minutes under stirring. The resultant mixture was further stirred for 3 hours. While this reaction mixture was kept at 50° C., and 800 ml of aqueous solution having 48% of sodium hydroxide was added dropwise thereto for 1 hour. The mixture was further stirred for 3 hours and then the reaction mixture was partitioned to plural layers by adding 400 ml of water. After the aqueous layer was removed, the oil layer was washed twice with 500 ml of water to obtain 320 g of a crude product after reaction.

Then, 140 g of the crude product after reaction, 140 g of water, 7.64 g of lauric acid and 2.14 g of potassium hydroxide were introduced into an autoclave having its capacity of 2 L and heated to 157° C. under stirring. After the resultant mixture wad stirred for 5 hours, it was cooled to room temperature and the resultant product after reaction was extracted with 500 ml of ethyl acetate and further washed twice with 300 ml of water. After the ethyl acetate was distilled off under reduced pressure, the resultant residues were applied to column chromatography. The obtained mixture was analyzed with a gas chromatography. As the result, it was a mixture containing a mixture containing 48% of the component (a), 27% of the component (b) and 25% of the component (c).

Preparative Example 6

Preparation of Mixture F

The mixture was prepared in the same manner as in Preparative Example 1 except that 1.78 mol of n-butyl alcohol was used in place of isoamyl alcohol. The obtained mixture was analyzed with a gas chromatography. As the result, it was a mixture containing 92% of the component (a), 3% of the component (b) and 5% of the component (c).

Preparative Example 7

Preparation of Mixture G

The mixture was prepared in the same manner as in Preparative Example 1 except that 1.78 mol of n-hexyl alcohol was used in place of isoamyl alcohol the obtained mixture was analyzed with a gas chromatography. As the result, it was a mixture containing 90% of the component (a), 3% of the component (b) and 7% of the component (c).

Example 1

Liquid Detergents for Clothing

The liquid detergents for clothing were prepared using the components for blend shown in Table 1. Then, they were evaluated for degree of degreasing fats shown below as an indication of their detergency. Further, the smell of each of liquid detergent was evaluated in the following manner. The results are shown in Table 1.

With respect to Preparation of an Artificially Smeared Cloth 200 g of triolein were dissolved in 80 L of Parklene (tetracloroethylene), and a cloth #2003 was immersed to make triolein adhere thereto followed by evaporating to remove the Parklene. The obtained cloth was an artificially smeared cloth.

With Respect to a Method for Evaluating the Power of Degreasing Fats 0.2 g of the composition was applied on a 2×2 cm of an area per 1 piece of the above-motioned artificially smeared cloth cut into 5×5 cm. A set of the 5 pieces was washed in a Terg-O-Tometer (with rinsing by a tap water, while the resultant smeared water was draining, at a water-temperature of 20° C., a hardness of 4° DH, a washing time of 10 minutes, 100 rpm, and for 5 minutes).

After washing, the part of the cloth to which the composition had been applied was accurately cut out, and another set of the cut 5 pieces was subjected to Soxhlet extraction with chloroform as a solvent for 12 hours. Further, the unwashed artificially smeared cloth was also subjected to the same extraction as above. Then, the chloroform in the solution for the extraction was distilled off under a reduced pressure in an evaporator, and the amount of the obtained and extracted triolein was determined and the degree of degreasing fats was determined according to the following formula:

Degree of degreasing fats (%)={(The extracted amount in case of the unwashed smeared cloth)−(The extracted amount in case of the washed smeared cloth)}/(The extracted amount in case of the unwashed smeared cloth)×100

With Respect to Evaluation of Smell 50 ml of the liquid detergent was placed in a wide-mouthed standard bottle (PS No. 11). The bottle was capped with a lid and stored in a thermostatic chamber at 20° C. for 2 hours. Thereafter, its smell was evaluated by 10 panelists (5 men in their thirties and 5 women in their twenties). That is, they examined the smell according to the following criteria to determine the average.

1: There is no or less nasty smell.

2: There is a slight nasty smell but the smell is not worried.

3: There is a nasty smell.

4: There is a strong nasty smell.

TABLE 1

| The compounding ingredients (% by weight) | The products of the present invention | | | Comparative products | |
|---|---|---|---|---|---|
| | 1 | 2 | 3 | 1 | 2 |
| (a)–(c) | | | | | |
| Mixture A | 10 | | | | |
| Mixture B | | 10 | | | |
| Mixture C | | | 10 | | |
| Mixture D | | | | 10 | |
| Mixture E | | | | | 10 |
| (d) | | | | | |
| Surfactant A | 10 | 10 | 10 | 10 | 10 |
| Surfactant B | | 5 | 5 | | 5 |
| Surfactant C | 5 | | | 5 | |
| Surfactant D | | 5 | 5 | | 5 |
| Surfactant E | 25 | 25 | 25 | 25 | 25 |

TABLE 1-continued

| The compounding ingredients (% by weight) | The products of the present invention 1 | 2 | 3 | Comparative products 1 | 2 |
|---|---|---|---|---|---|
| Other components | | | | | |
| Polymer | 1 | 1 | 1 | 1 | 1 |
| Polypropyleneglycol | 5 | 5 | 5 | 5 | 5 |
| Ethanol | 5 | 5 | 5 | 5 | 5 |
| Na p-toluene sulfonate | 0.5 | 0.5 | 0.5 | 0.5 | 0.5 |
| Monoethanolamine | 4 | 4 | 4 | 4 | 4 |
| Water * | Balance | Balance | Balance | Balance | Balance |
| pH ** | 10.5 | 10.5 | 10.5 | 10.5 | 10.5 |
| Evaluation | | | | | |
| Degree of degreasing fats | 92 | 94 | 90 | 85 | 83 |
| Evaluation of smell | 1.3 | 1.2 | 1.4 | 1.5 | 1.6 |

(Notes)
Surfactant A: An adduct with 5 mole of EO, 2 mole of PO and 3 mole of EO in state of block to a primary alcohol having 10 to 14 carbon atoms.
Surfactant B: An alkyl polyglucoside having an alkyl group having 12 carbon atoms (with 1.5 of the average degree of polymerization).
Surfactant C: A monoalkyl trimethyl ammonium chloride which has alkyl groups having 16 and 18 carbon atoms (with the ratio of these contents being 3:7).
Surfactant D: Octyl dimethyl benzyl ammonium chloride.
Surfactant E: Polyoxyethylene (with 2.5 moles of PO) lauryl ether sulfuric acid sodium salt.
Polymer: Maleic acid/diisobutene copolymer (with the molar ratio of 1/1) having its molecular weight of 10,000.
Polypropyleneglycol (having 15 of the average degree of polymerization)
* : The total of the detergent was adjusted with water to 100% by weight.
** : The pH was adjusted with an aqueous solution having 0.1 N of NaOH and another 0.1 N aqueous solution having aqueous $H_2SO_4$.

Example 2

Liquid Detergent 1 for Hard Surfaces

The liquid detergent 1 for hard surfaces was prepared using the compounding ingredients shown in Table 2. Then, these were evaluated for detergency towards oil smears shown below and for the above described smell. The results are shown in Table 2.

With Respect to a Method for Evaluating Detergency Towards Oil Smears 10 g of cooking oil (e. g. Nisshin Corn Oil by Nisshin Oil Mills) was applied uniformly onto an iron plate. The plate was baked at the temperature of 180° C. for 30 minutes and then was further left at room temperature for 3 months to prepare a model of a smeared plate. 0. 5 ml of the liquid detergent was dropped onto the model of a smeared plate fixed horizontally and was left for 1 minute. Thereafter, the resultant floated smear was removed lightly with absorbent cotton. This operation was carried repeatedly out 20 times, and the degree of each of washing was examined visually and evaluated according to the following criteria to determine the average.

1: The smears were removed almost completely.
2: About 20 to 30% of the smears remained.
3: About 50 to 70% of the smears remained.
4: The smears were not removed at all.

TABLE 2

| The compounding ingredients (% by weight) | The products of the present invention 4 | 5 | 6 | 7 | 8 | Comparative products 3 | 4 |
|---|---|---|---|---|---|---|---|
| (a)–(c) | | | | | | | |
| Mixture A | 5 | | | | | | |
| Mixture B | | 5 | | | | | |
| Mixture C | | | 5 | | | | |
| Mixture D | | | | | | 5 | |
| Mixture E | | | | | | | 5 |
| Mixture F | | | | 5 | | | |
| Mixture G | | | | | 5 | | |
| (d) | | | | | | | |
| Surfactant A | 3 | 2 | 3 | 2 | 3 | 3 | 2 |
| Surfactant B | 2 | 2 | 2 | 2 | 2 | 2 | 2 |
| Surfactant E | 3 | | 3 | | 3 | 3 | |
| Surfactant F | 3 | | 3 | | 3 | 3 | |
| Surfactant G | | 1 | | 1 | | | 1 |
| Other components | | | | | | | |
| Ethanol | 5 | 5 | 5 | 5 | 5 | 5 | 5 |
| Monoethanolamine | 5 | 5 | 5 | 5 | 5 | 5 | 5 |
| Water * | Balance | Balance | Balance | Balance | Balance | Balance | Balance |
| Total (% by weight) | 100 | 100 | 100 | 100 | 100 | 100 | 100 |
| pH ** | 12 | 12 | 12 | 12 | 12 | 12 | 12 |
| Evaluation | | | | | | | |

TABLE 2-continued

| The compounding ingredients (% by weight) | The products of the present invention 4 | 5 | 6 | 7 | 8 | Comparative products 3 | 4 |
|---|---|---|---|---|---|---|---|
| Detergency for oil smears | 1.2 | 1.1 | 1.8 | 1.3 | 1.2 | 2.4 | 2 |
| Evaluation of smell | 1.5 | 1.4 | 1.5 | 1.5 | 1.4 | 1.7 | 1.8 |

(Notes)
Surfactant F: Lauryl dimethyl amine oxide.
Surfactant G: An adduct with 5 moles of EO to lauryl amine.
(The description of the same ingredients as in Example 1 is omitted.)

Example 3

Liquid Detergent 2 for Hard Surfaces

The liquid detergent 2 for hard surfaces was prepared using the compounding ingredients shown in Table 3. Then, these were evaluated for detergency towards soap scums shown below and for the above-described smell. The results are shown in Table 3.

With Respect to a Method for Evaluating Detergency Towards Soap Scums

A washbowl (made of polypropylene) having soap scums thereon after 3-month actual use was rubbed 5 times with a polyurethane sponge impregnated with 0. 5 g of the liquid detergent and 20 g of water with an about 500 g of load. This operation was carried repeatedly out 20 times. The degree of each of cleaning was visually examined according to the following criteria to determine the average of the 20 measurements.

1: The smears were removed almost completely.

2: About 20 to 30% of the smears remained.

3: About 50 to 70% of the smears remained.

4: The smears were not removed at all.

TABLE 3

| The compounding ingredients (% by weight) | The products of the present invention 9 | 10 | 11 | 12 | 13 | Comparative products 5 | 6 |
|---|---|---|---|---|---|---|---|
| (a)–(c) | | | | | | | |
| Mixture A | 5 | | | | | | |
| Mixture B | | 5 | | | | | |
| Mixture C | | | 5 | | | | |
| Mixture D | | | | | | 5 | |
| Mixture E | | | | | | | 5 |
| Mixture F | | | | 5 | | | |
| Mixture G | | | | | 5 | | |
| (d) | | | | | | | |
| Surfactant A | 1 | 2 | 1 | 2 | 1 | 1 | 2 |
| Surfactant B | 1 | 1 | 1 | 1 | 1 | 1 | 1 |
| Surfactant D | | 2 | | 2 | | | 2 |
| Surfactant E | 3 | 2 | 3 | 2 | 3 | 3 | 2 |
| Surfactant H | 2 | | 2 | | 2 | 2 | |
| Other components | | | | | | | |
| EDTA | 2 | 2 | 2 | 2 | 2 | 2 | 2 |
| Citric acid | 2 | 2 | 2 | 2 | 2 | 2 | 2 |
| Water * | Balance | Balance | Balance | Balance | Balance | Balance | Balance |
| pH ** | 7 | 7 | 7 | 7 | 7 | 7 | 7 |
| Total (% by weight) | 100 | 100 | 100 | 100 | 100 | 100 | 100 |
| Evaluation | | | | | | | |
| Detergency for soap scums | 1.0 | 1.1 | 1.7 | 1.2 | 1.1 | 2 | 1.9 |
| Evaluation of smell | 1.2 | 1.3 | 1.5 | 1.4 | 1.2 | 1.9 | 1.8 |

(Notes)
Surfactant H: Monoalkyl trimethyl ammonium chloride which has an alkyl group having 10 carbon atoms.
EDTA: Na salt of ethylene diamine tetraacetic acid
(The description of the same ingredients as in Example 1 or 2 is omitted.)

Example 4

Liquid Detergent for Clothing

Excellent detergency for sebum smears is obtained by the liquid detergents for clothing prepared by use of the compounding ingredients shown in Table 4.

TABLE 4

| The compounding ingredients (% by weight) | The products of the present invention | | | | |
|---|---|---|---|---|---|
| | 14 | 15 | 16 | 17 | 18 |
| (a)~(c) | | | | | |
| Mixture A | 10 | 10 | | | |
| Mixture B | | | 5 | 10 | 10 |
| (d) | | | | | |
| Surfactant A | | | | | 5 |
| Surfactant E | 20 | 20 | 20 | 20 | 20 |
| Surfactant I | 5 | 5 | 5 | 5 | 5 |
| Surfactant J | 10 | | 10 | 10 | 5 |
| Surfactant K | | 10 | | | 5 |
| Other components | | | | | |
| Citric acid | 1 | 1 | 1 | 1 | 1 |
| Monoethanolamine | 4 | 4 | 4 | 4 | 4 |
| Propyleneglycol | 2 | 2 | 2 | 2 | 7 |
| Protease | 1 | 1 | 1 | 1 | 1 |
| fluorescent dye | 0.2 | 0.2 | 0.2 | 0.2 | 0.2 |
| Sodium sulfite | 0.1 | 0.1 | 0.1 | 0.1 | 0.1 |
| Perfume | 0.3 | 0.3 | 0.3 | 0.3 | 0.3 |
| Ethanol | 2 | 2 | 2 | 2 | 2 |
| Water * | Balance | Balance | Balance | Balance | Balance |
| Total (% by weight) | 100 | 100 | 100 | 100 | 100 |

(Notes)
Surfactant I: A palm oil fatty acid.
Surfactant J: A polyoxyethylene alkyl ether (which is an adduct with 6 moles on average of EO to a linear secondary alcohol having 12 to 14 carbon atoms).
Surfactant K: A polyoxyethylene alkyl ether (which is an adduct with 6 moles on average of EO to a linear primary alcohol having 12 to 14 carbon atoms), wherein the compounds having their numbers of added moles [n(max) − 2] to [n(max) + 2] is 64% by weight and wherein the amount of the alcohol to which EO has not been added is 1.1% by weight).
Protease: Savinase 16.0T (Novo Nordisk A/S)
Fluorescent dye: Chinopal CBS (Ciba-Geigy)
(The description of the same ingredients as in Example 1, 2 or 3 is omitted.)

Example 5

Liquid Detergent for Tableware

The liquid detergent for tableware prepared by use of the compounding ingredients shown in Table 5 exhibits excellent detergency towards oil smears.

TABLE 5

| The compounding ingredients (% by weight) | The products of the present invention | | | |
|---|---|---|---|---|
| | 19 | 20 | 21 | 22 |
| (a)~(c) | | | | |
| Mixture A | 5 | 5 | | |
| Mixture B | | | 5 | 5 |
| (d) | | | | |
| Surfactant B | | 25 | | 25 |
| Surfactant E | 25 | 2 | 25 | 2 |
| Surfactant F | 3 | 2 | 3 | 2 |
| Surfactant J | 5 | | 5 | |
| Surfactant L | 3 | | 3 | |
| Other components | | | | |
| Citric acid | | 0.5 | | 0.5 |
| Propyleneglycol | 3 | | 3 | |
| Na benzoate | | 1 | | 1 |
| PTS | 3 | 3 | 3 | 3 |
| Ethanol | 5 | 5 | 5 | 5 |
| Perfume | 0.3 | 0.3 | 0.3 | 0.3 |
| Water * | Balance | Balance | Balance | Balance |
| Total (% by weight) | 100 | 100 | 100 | 100 |

(Notes)
Surfactant L: A palm-kernel oil fatty acid diethanolamide.
PTS: Sodium p-toluene sulfonate.
(The description of the same ingredients as in Example 1, 2, 3 or 4 is omitted.)

Example 6

Liquid Detergent for Human Body

A shampoo composition prepared by using the ingredients showed in Table 6 exhibits excellent forming property and rinsing property.

TABLE 6

| The compounding ingredients (% by weight) | | The products of the present invention | | |
|---|---|---|---|---|
| | | 23 | 24 | 25 |
| (a)~(c) | Mixture B | 5 | 5 | 3 |
| | Mixture C | | | 12 |
| (d) | Surfactant E | 15 | 12 | 15 |
| Other components | Citric acid (aqueous solution comprising 50% thereof) | The amount adjusting pH to 7 | | |
| | Ethanol | 1 | 1 | 1 |
| | Perfume | 0.3 | 0.3 | 0.3 |
| | Water | Balance | Balance | Balance |
| Total (% by weight) | | 100 | 100 | 100 |

(The description of the same ingredients as in Example 1, 2, 3, 4 or 5 is omitted.)

What is claimed is:

1. A liquid detergent, comprising four (4) structurally distinct chemical moieties (a)–(d), which are:

(a) a compound represented by the following formula (1), (b) a compound represented by the following formula (2), (c) a compound represented by the following formula (3) and (d) a surfactant, wherein (a)+(b)+(c)=0.1 to 50% by weight, (a)/[(a)+(b)+(c)]=0.5 to 0.99, (b)/[(a)+(b)+(c)]=0.005 to 0.25 and (c)/[(a)+(b)+(c)]=0.005 to 0.25 (of which each and all are the ratios by weight):

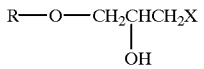
(1)

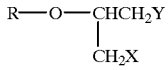
(2)

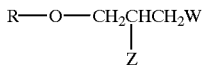
(3)

wherein R represents a hydrocarbon group having 1 to 16 carbon atoms, X is selected from the group consisting of a hydroxyl group and an OR group, Y is also selected from the group consisting of a hydroxyl group and an OR group, and Z is selected form the group consisting of a hydroxyl group,

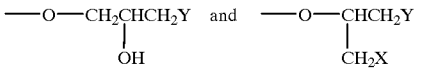

and W is also selected from the group consisting of a hydroxyl group,

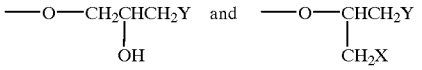

provided that one of Z and W is a hydroxyl group, but not both of them.

2. The liquid detergent as claimed in claim 1, wherein further (d)/[(a)+(b)+(c)]=0.1 to 10 (, which is the ratio by weight).

3. The liquid detergent as claimed in claim 1 or 2, wherein R in the formulae (1), (2) and (3) is an alkyl group having 4 to 10 carbon atoms.

4. The liquid detergent as claimed in claim 1 or 2, which is used for cleaning by application.

5. The liquid detergent as claimed in claim 1, which comprises 40 to 99% by weight of water.

* * * * *

UNITED STATES PATENT AND TRADEMARK OFFICE

CERTIFICATE OF CORRECTION

PATENT NO. : 6,387,867 B1
DATED : May 14, 2002
INVENTOR(S) : Akira Ishikawa et al.

It is certified that error appears in the above-identified patent and that said Letters Patent is hereby corrected as shown below:

Title Page,
Item [75], Inventors: please correct the second inventor's name from "Takumi Inoeu" to -- Takumi Inoue --.

Signed and Sealed this

Thirty-first Day of December, 2002

JAMES E. ROGAN
*Director of the United States Patent and Trademark Office*